US005220829A

United States Patent [19]

Manke et al.

[11] Patent Number: 5,220,829

[45] Date of Patent: Jun. 22, 1993

[54] DOWNHOLE FORMATION PUMP

[75] Inventors: Kevin R. Manke, Flower Mound, Tex.; David R. Smith, Quito, Ecuador; Harold E. Powers, Wabamun, Canada

[73] Assignee: Halliburton Company, Duncan, Okla.

[21] Appl. No.: 602,021

[22] Filed: Oct. 23, 1990

[51] Int. Cl.[5] ..... E21B 47/00

[52] U.S. Cl. ..... 73/155; 166/264; 418/48

[58] Field of Search ..... 73/155; 166/264; 418/48

[56] References Cited

U.S. PATENT DOCUMENTS

| | | | |
|---|---|---|---|
| 2,674,126 | 4/1954 | Coberly | 73/155 |
| 3,113,455 | 12/1963 | Sloan et al. | 73/155 |
| 4,187,918 | 2/1980 | Clark | 175/39 |
| 4,592,427 | 6/1986 | Morgan | 166/369 |
| 5,097,902 | 3/1992 | Clark | 166/187 |

FOREIGN PATENT DOCUMENTS

| | | | |
|---|---|---|---|
| 3818508 | 12/1989 | Fed. Rep. of Germany | 418/48 |
| 0443156 | 11/1974 | U.S.S.R. | 418/48 |

OTHER PUBLICATIONS

Exhibit A—Traco Industries, Inc. brochure entitled "SSJ TM For DST Drill Stem Testing" (1987).

Exhibit B—SPE Paper No. 9607, Cobbett, "Use of a Down-Hole Mud Motor as a Pump for Drill-Stem Testing" (1981).

Exhibit C—"Norton Christensen Information" (1984).

Exhibit D—Portion of brochure of Norton Christensen (undated but admitted to be prior art).

Exhibit E—Brochure of Eastman Christensen entitled "Subsurface Oil Well Pumps Econo-pump" (undated but admitted to be prior art).

Exhibit F—Bulletin 300B of Robbins & Myers entitled "Moyno Down-Hole Oil Well Pumps" (undated but admitted to be prior art).

Exhibit G—Bulletin 310 of Robbins & Myers entitled "How We Build Your Moyno® Motor" (1985).

*Primary Examiner*—Hezron E. Williams

*Assistant Examiner*—George M. Dombroski

*Attorney, Agent, or Firm*—James R. Duzan; L. Wayne Beavers

[57] ABSTRACT

A downhole formation test pump includes a progressive cavity pump having a helical rotor received in a helical cavity of a stator. The pump may be disengaged by withdrawing the rotor from the stator to provide a bypass position so that the downhole formation being tested can be allowed to flow freely if it is capable.

18 Claims, 3 Drawing Sheets

DOWNHOLE FORMATION PUMP

BACKGROUND OF THE INVENTION

1. Field Of The Invention

The present invention relates generally to downhole pumps for testing of wells, and more particularly, to a downhole progressive cavity type pump.

2. Description Of The Prior Art

After a well has been drilled it is common practice to test the production capabilities of the subsurface producing formations so that the well completion may be properly designed and constructed.

A problem is often encountered in that some subsurface formations do not have enough reservoir pressure to produce well fluids to the surface against a full column of fluid in the well. These wells pose a problem in their analysis during testing because the time interval over which the well will naturally flow is not long enough to determine the full reservoir parameters.

One common method for testing these wells is to utilize a downhole pump of the jet pump type. The jet pump uses a separate fluid pumped down the well annulus and ported into the testing string to raise the formation fluids by a jetting action. An example of such a jet pump is the SSJ TM jet pump available from Trico Industries, Inc., of Huntington Park, Calif. Such a jet pump system is not ideal because of the power requirements and because of problems created by the mixing of the power fluid and the produced formation fluids.

Another pump which has been utilized as a downhole formation pump in a test string is a progressive cavity type pump. SPE Paper No. 9607, "Use of a Down-hole Mud Motor as a Pump for Drill-Stem Testing", Cobbett, 1981, discloses the use of a progressive cavity pump in a drill stem test string. This progressive cavity pump has its rotor permanently in place within the stator, and the test string does not include a tester valve since well fluid cannot freely flow through the test string. The only manner in which well fluid can flow through the test string is by operation of the progressive cavity pump which blocks the flow passage through the test string.

SUMMARY OF THE INVENTION

The present invention provides an improved downhole pump of the progressive cavity type, and a test string utilizing such a pump.

A testing string extends down into a well bore of a well, and the string has a tubing bore defined therethrough. A retrievable packer is disposed on the testing string for temporarily sealing a well annulus between the testing string and the well bore above a subsurface zone which is to be tested.

Communication means such as a perforated tail pipe is defined in the testing tubing string below the packer for communicating well fluid from the subsurface zone with the tubing bore.

The testing string includes a test pump which includes a progressive cavity type pump means for pumping fluid from the subsurface zone upward through the tubing bore and a bypass means for allowing well fluid to pass upwardly past the progressive cavity pump means without being pumped by the progressive cavity pump means when the subsurface zone is capable of unassisted flow. The bypass mean preferably includes a means for withdrawing a helical rotor of the progressive cavity pump means from a helical cavity of the progressive cavity pump means thus permitting free flow of well fluids upward through the helical cavity and around the withdrawn rotor.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
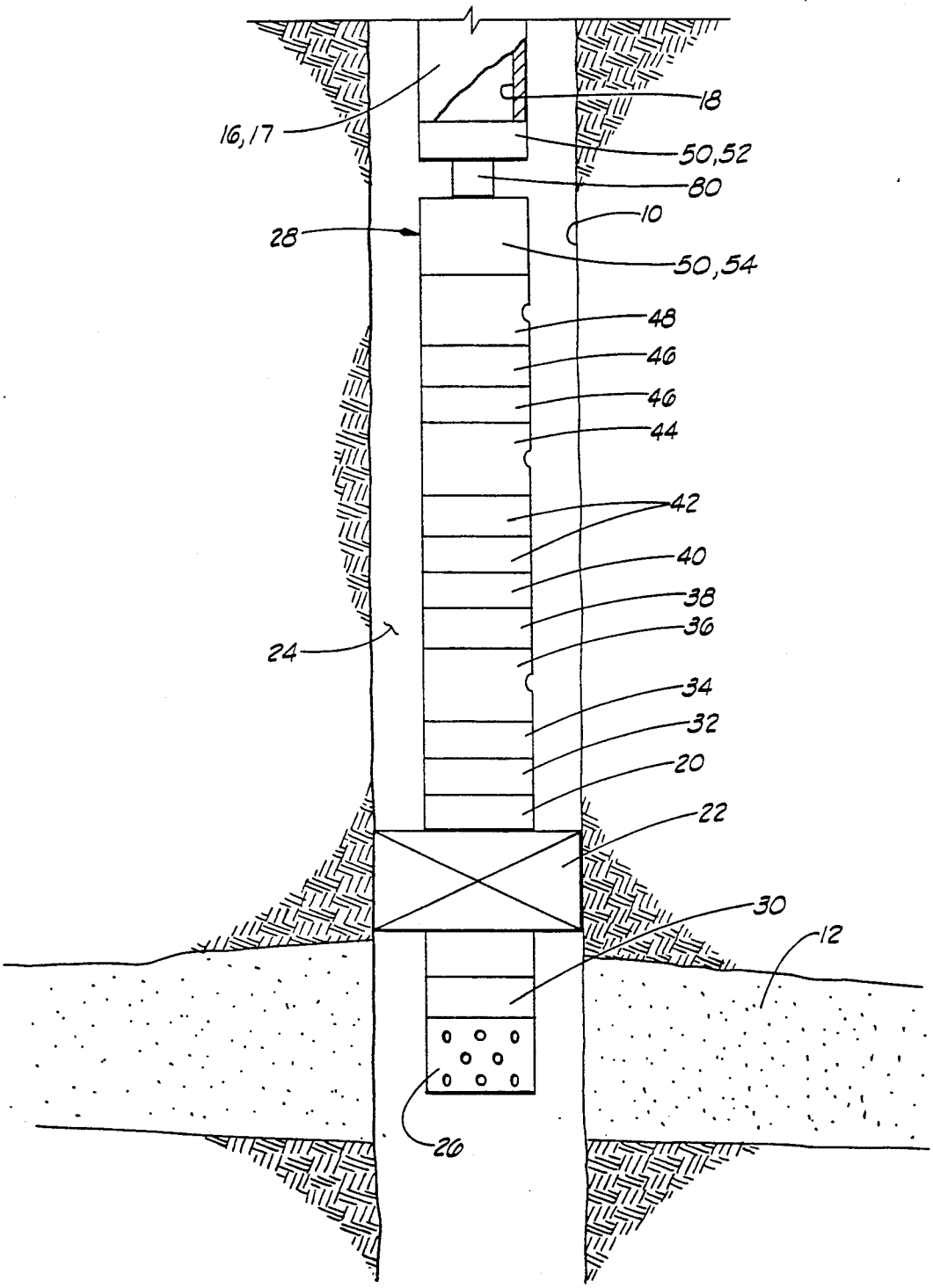
FIG. 1 is a schematic elevation, partially sectioned view of a drill stem test string in place within a well bore.

Referring now to the drawings, and particularly to FIG. 1, a drill stem test string incorporating the progressive cavity testing pump of the present invention is there illustrated.

In FIG. 1, a well bore 10 has been drilled into the earth and intersects a subsurface formation 12 which is to be tested. A drill stem testing string 16, is shown in place within the well 10.

The testing string 16 includes a plurality of joints of tubing 17 of sufficient length to carry the remaining components of the testing string 16 to the desired depth within the well 10. The testing string 16 has a tubing bore 18 defined therethrough.

Testing string 16 includes a retrievable packer means 20 having an expandable packer element 22 for temporarily sealing a well annulus 24 between the testing string 16 and the well bore 10 above the subsurface zone 12 which is to be tested.

A communication means 26 such as a perforated tail pipe 26, is defined in the testing string 16 below the packer means 20 for communicating well fluid from the subsurface zone 12 with the tubing bore 18.

It is noted that all of those components attached to and suspended below the joints of tubing 17 include passageways which communicate with and can be considered to form a part of the tubing bore 18 of testing string 16.

A tester pump 28 is carried by the testing string 16 for pumping well fluid from the subsurface zone 12 upward through the tubing bore 18.

The other components which will typically be included in the testing string 16 are schematically illustrated in FIG. 1 and are generally as follows.

The testing string 16, from bottom to top, includes the perforated tail pipe or anchor 26, a gauge carrier 30, the packer means 20, a safety joint 32, one or more jars 34, a bypass circulating valve 36, a gauge carrier 38, a drill stem tester valve 40, a plurality of drill collars 42 to provide weight for setting packer 20, a circulating valve 44, more drill collars 46, another circulating valve 48, then the test pump 28.

Figure 2A:
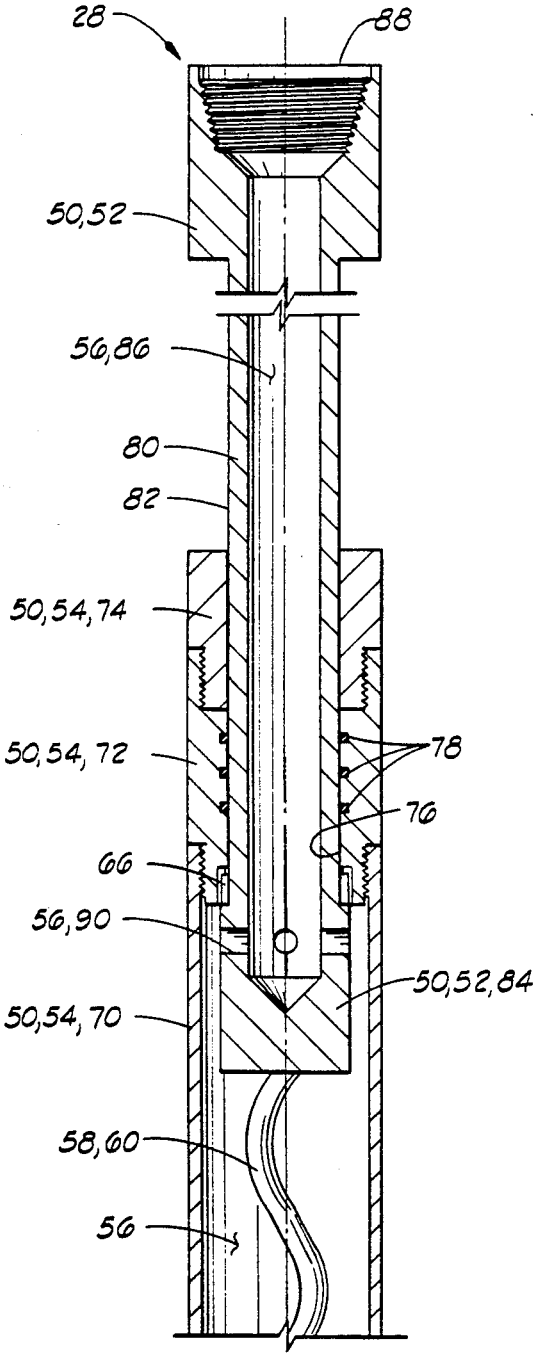
FIGS. 2A–2B comprise an elevation sectioned schematic illustration of the progressive cavity downhole testing pump of the present invention with the helical rotor withdrawn from the helical cavity of the stator so that well fluid may freely flow upward through the pump.
Figure 2B:
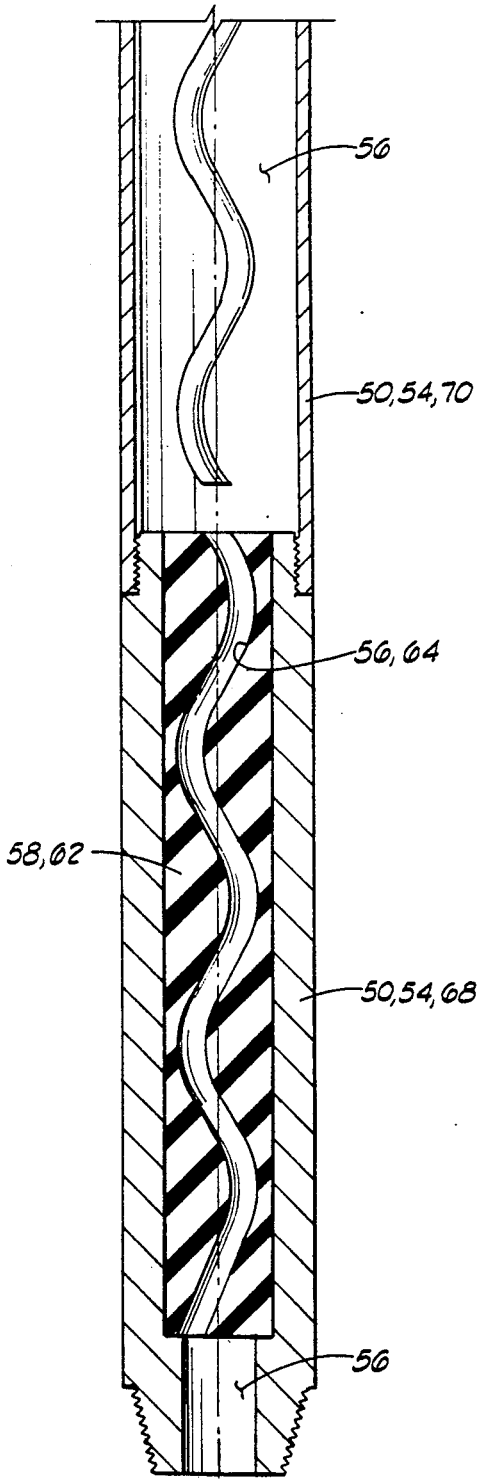

Referring now to FIGS. 2A-2B, the details of construction of the test pump 28 are there schematically illustrated.

The test pump 28 includes a pump housing 50 having an upper first pump housing section 52 and a lower second pump housing section 54. The upper first pump housing section 52 has its lower end telescopingly received in the lower second pump housing section 54. The pump housing 50 is shown in shown in FIGS. 3A-3B in its telescopingly collapsed position.

Pump housing 50 has a housing passageway generally designated by the numeral 56 defined generally lengthwise therethrough.

Disposed in the pump housing 50 is a progressive cavity pump means 58 for pumping well fluid through the housing passageway 56. Pump means 58 includes a helical male portion or rotor 60 carried by the upper first housing section 52 and a female portion or stator 62 carried by the lower second housing section 54 and having a helical cavity 64 defined therethrough. The helical cavity 64 forms a part of the housing passageway 56.

Figure 3A:
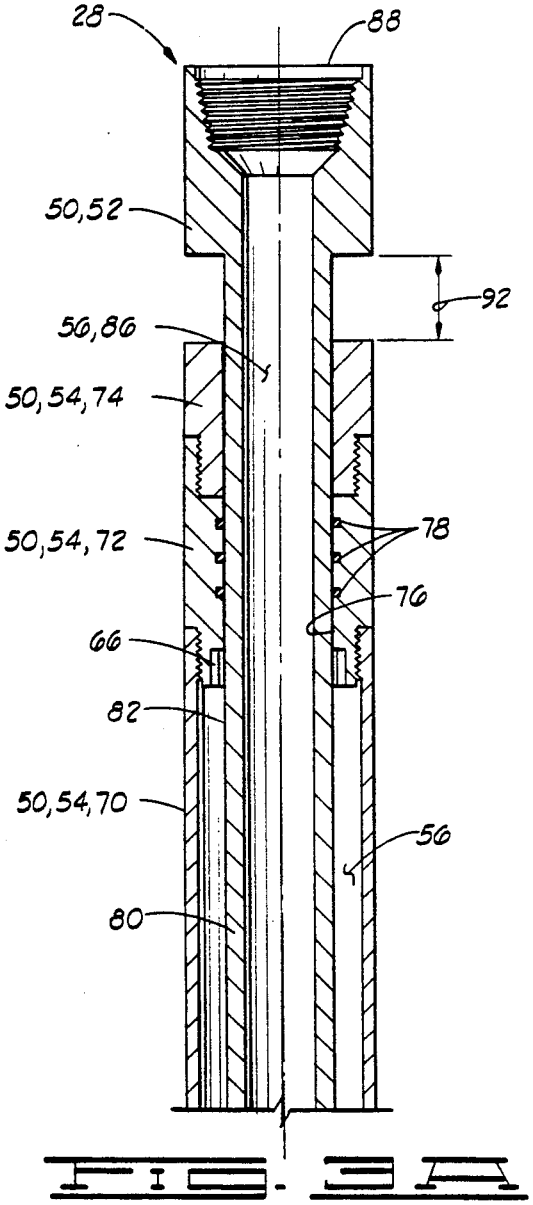
FIGS. 3A–3B comprise an illustration of the pump of received in the stator so that the pump is operative to pump well fluids upward therethrough upon rotation of the rotor.
Figure 3B:
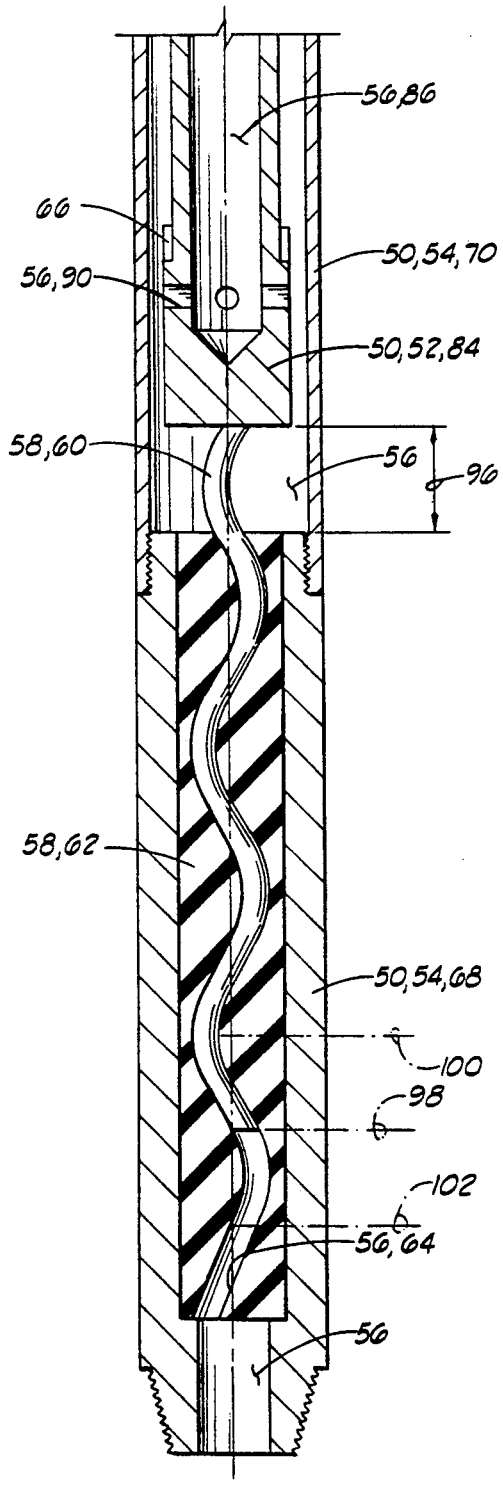

The pump housing 50 and progressive cavity pump means 58 are so arranged and constructed that when the pump housing 50 is in its telescopingly extended position as shown in FIGS. 2A-2B, the rotor 60 is withdrawn from the helical cavity 64 of stator 62. Further, when the pump housing 52 is in its telescopingly collapsed position as shown in FIGS. 3A-3B, the rotor 60 is received within helical cavity 64 of stator 62 so that upon rotation of the first pump housing section 52 by rotating the test string 16 the rotor 60 is rotated within helical cavity 64 thereby pumping well fluids from formation 12 upward through the housing passageway 56 and up through the tubing bore 18 of testing string 16.

A releasable interlocking means 66 is provided for interlocking the first and second pump housing sections 52 and 54 to prevent relative rotational motion therebetween when the pump housing 50 is in its telescopingly extended position as seen in FIGS. 2A-2B. The interlocking means 66 is preferably formed by a plurality of interlocking splines defined on pump housing sections 52 and 54 as seen in FIG. 2A. Upon movement of the pump housing 50 to its telescopingly collapsed position as seen in FIGS. 3A-3B, the splines 66 disengage thus permitting rotation of the upper pump housing section 52 relative to the lower pump housing section 54 so that the progressive cavity pump means 58 may be operated.

The lower pump housing section 54 is made up, from bottom to top, of a stator housing 68, a bypass housing 70, a seal assembly 72, and an upper cap 74.

The seal assembly 72 has a seal bore 76 defined therethrough and has a plurality of seals 78 disposed in the seal bore 76.

The upper first pump housing section 52 includes a polished mandrel 80 having a polished cylindrical outer surface 82 which is closely and slidably received within the seal bore 76. Upper pump housing section 52 further includes an enlarged crossover head 84 defined on an inner end of the polished mandrel 80 and received within the bypass housing 70 of lower pump housing section 54.

The rotor 60 is rigidly attached to the crossover head 84 and extends downwardly into the lower second pump housing section 54.

The upper pump housing section 52 has a longitudinal bore 86 extending from an upper or outer end 88 thereof through the polished mandrel 80 and intersecting a plurality of laterally extending crossover ports 90 defined in the crossover head 84. The longitudinal bore 86 and crossover ports 90 define a portion of the housing passageway 56.

The seals 78 define an annular seal means 78 disposed between the first and second housing sections 52 and 54 for sealing the housing passageway 56 from the exterior of the pump housing 50.

The intermeshing splines making up the releasable interlocking means 66 are defined on the lower inside periphery of seal assembly 72 and on the upper outside periphery of crossover head 84.

The bypass housing 70 is of sufficient length, and the polished mandrel 80 has sufficient stroke, that when the pump housing 50 is moved to its telescopingly extended position as seen in FIGS. 2A-2B, the rotor 60 is completely withdrawn from helical cavity 64 of stator 62, thus providing a bypass means for allowing well fluid to pass upwardly past the progressive cavity pump means 58 without being pumped by the progressive cavity pump means 58 when the subsurface zone 12 is capable of unassisted free flow to the surface of the well 10.

It is preferred when the pump housing 50 is moved to its telescopingly collapsed position of FIGS. 3A-3B, that there be no weight bearing engagement of any portion of upper housing section 52 with lower housing section 54. There should be a clearance 92 between an enlarged upper head 94 of upper housing section 52 and the upper cap 74 of lower housing section 54. There should be a clearance 96 between the crossover head 84 and the stator 62. This eliminates the need for a rotary thrust bearing between upper pump housing section 52 and lower pump housing section 54.

This result can be accomplished by making the rotor 60 and the helical cavity 64 of sufficient length that there is a range of acceptable insertion depths of the rotor 60 within cavity 64 which can be reliably achieved with the available precision of placement of the testing string 16 within well 10.

In FIGS. 3A-3B the rotor 60 is shown placed at a preferred depth 98 within cavity 64. The length of rotor 60 and cavity 64 is such that if the insertion depth is anywhere between 100 and 102 there will be sufficient engagement of rotor 60 and cavity 64 to pump well fluid at a rate sufficient to test the subsurface zone 12. Preferably there is a range of at least two feet between depth elevations 100 and 102.

MANNER OF OPERATION OF THE DOWNHOLE PUMP 28

The testing string 16 including the downhole formation pump 28 may be used in the following manner to test the subsurface zone 12 of a well. The inclusion of the bypass means in the downhole formation pump 28 permits great flexibility, in that if the subsurface formation 12 is capable of free flow, the same is permitted. On the other hand, if the subsurface formation 12 is found to not be capable of free flow, the progressive cavity pump means 58 may be easily engaged and utilized to pump formation fluids up to the surface.

The testing string 16 including the packer 20, the tester valve 40 and the test pump 28 is run into the well 10 to a desired depth. The test string 16 may optionally include any or all of the other components previously described with regard to FIG. 1.

As the test string 16 is run into the well, the tester valve 40 will normally be maintained in a closed position to prevent the test string 16 from filling with well fluid as it is run into the well. The pump 28 will typically be in its telescopingly extended position since the test string will be in tension as it is being lowered into the well.

After the test string is located at its desired elevation within the well 10, the packer 20 is set. The packer 20 preferably is of the type which is set with a combination of right-hand torque and downward movement of the test string 16. The downward movement is applied by setting down the weight of the drill collars 42 and 46 on the packer means 20 while applying right-hand torque to the test string 16. This right-hand torque is transmitted through the pump 28 since the same is still in its telescopingly extended position as in FIGS. 2A–2B, and the interlocking splines 66 will transmit the torque therethrough.

After the packer 20 is set, the pump 28 is maintained in its bypass position as illustrated in FIGS. 2A–2B while the tester valve 40 is opened. If the formation 12 is capable of freely flowing fluids to the surface of the well, the same can freely flow upwards through the pump 28 and up through the tubing bore 18 to the surface.

If the formation 12 is not capable of freely flowing formation fluids to the surface, the progressive cavity pump means 58 can be operated. First, weight is set down on the test string 16 to move the pump 28 to its telescopingly collapsed position as seen in FIGS. 3A–3B wherein the rotor 60 is inserted into the helical cavity 64 of stator 62. In the first few inches of downward travel of upper pump housing section 52 relative to lower pump housing section 54, the splines 66 will disengage.

Once the rotor 60 is inserted into the helical cavity 64 of stator 62, the progressive cavity pump means 58 is operated by rotating the test string 16 and the upper pump housing section 52 relative to the lower pump housing section 54 thus rotating the rotor 60 within the helical cavity 64 and pumping well fluids upward through the housing passageway 56 and the tubing bore 18. The flow rate of fluids pumped through the progressive cavity pump means 58 is easily adjusted by adjusting the rotational speed of the test string 16.

This system provides numerous advantages over the prior art systems previously mentioned.

As compared to a jet pump system, there is no requirement for pumping facilities on the surface to provide the power fluid which must be pumped down to the jet pump. Further, the problem of mixing of power fluid and formation fluid and the subsequent requirement of separation of those fluids and disposal of the used power fluids are eliminated.

As compared to other downhole progressive cavity type testing pumps, the present system provides a bypass means which allows the formation 12 to freely flow if it is capable. This flexibility of operation was not available with prior art downhole progressive cavity type tester pumps.

Thus it is seen that the apparatus and methods of the present invention readily achieve the ends and advantages mentioned as well as those inherent therein. While certain preferred embodiments of the invention have been illustrated and described for purposes of the present disclosure, numerous changes in the arrangement and construction of the system may be made by those skilled in the art, which changes are encompassed within the scope and spirit of the present invention as defined by the appended claims.

What is claimed is:

1. An apparatus for testing a subsurface zone of a well, comprising:

a testing string extending down into a well bore of said well, said testing string having a tubing bore defined therethrough, said testing string including:

packer means for sealing a well annulus between said testing string and said well bore above said subsurface zone which is to be tested;

communication means for communicating well fluid from said subsurface zone with said tubing bore; and a test pump including progressive cavity pump means for pumping said well fluid from said subsurface zone upward through said tubing bore and bypass means for allowing said well fluid to pass upwardly past said progressive cavity pump means without being pumped by said progressive cavity pump means when said subsurface zone is capable of unassisted flow, said progressive cavity pump means including a female portion having a helical cavity defined therethrough and a male portion receivable within said helical cavity, said male portion and female portion being so arranged and constructed that upon rotation of said testing string, said male portion is rotated within said helical cavity of said female portion and said well fluid is pumped upward through said helical cavity, said bypass means including a means for withdrawing said male portion from said helical cavity so that said well fluid may freely flow through said helical cavity.

2. The apparatus of claim 1, wherein said test pump further comprises:

a pump housing including telescoping upper and lower housing sections;

a first one of said telescoping upper and lower housing sections having a first housing passageway portion defined therein, and having said male portion of said progressive cavity pump means attached thereto;

a second one of said telescoping upper and lower housing sections having a second housing passageway portion defined therein and having said female portion of said progressive cavity pump means disposed therein so that said helical cavity defines a part of said second housing passageway portion; and wherein said means for withdrawing includes said upper and lower housing sections being so arranged and constructed that when said housing sections are in a telescopingly collapsed position said male portion is received within said helical cavity of said female portion so that well fluid may only flow through said helical cavity due to pumping of said well fluid by said progressive cavity pump means, and when said housing sections are in a telescopingly extended position said male portion is withdrawn from said helical cavity of said female portion so that well fluid can freely flow up through both said first and second housing passageway portions.

3. The apparatus of claim 2, wherein said test pump further comprises:

releasable interlocking means for interlocking said upper and lower housing sections to prevent relative rotational motion therebetween when said housing sections are in their telescopingly extending position so that rotational motion of said testing string may be transmitted through said pump housing to set said packer means, said interlocking means being released when said housing sections move to their telescopingly collapsed position so that said testing string can rotate said upper housing section relative to said lower housing section to operate said progressive cavity pump means and pump said well fluid upward therethrough.

4. The apparatus of claim 3, wherein said test pump further comprises:

an annular seal disposed between said upper and lower housing sections.

5. The apparatus of claim 2, wherein:

said upper housing section is received within said lower housing section;

said male portion of said progressive cavity pump means is attached to said upper housing section; and said female portion of said progressive cavity pump means is disposed in said lower housing section.

6. The apparatus of claim 1, wherein:

said male portion and said helical cavity of said female portion are each of sufficient length that a depth of insertion of said male portion within said helical cavity of said female portion can vary within a range of at least two feet and still provide sufficient engagement to pump said well fluid at a rate sufficient to test said subsurface zone.

7. A downhole test pump apparatus, comprising:

a pump housing including first and second pump housing sections, one of said housing sections being telescopingly received in the other of said pump housing sections, said housing sections being movable between a telescopingly extended position of said pump housing and a telescopingly collapsed position of said pump housing, said pump housing having a housing passageway defined lengthwise therethrough;

progressive cavity pump means, disposed in said pump housing, for pumping well fluid through said housing passageway, said pump means including a male portion carried by said first housing section and a female portion carried by said second housing section, said female portion having a helical cavity defined therethrough forming a part of said housing passageway; and said pump housing and said progressive cavity pump means being so arranged and constructed that when said pump housing is in its said telescopingly extended position said male portion is withdrawn from said helical cavity of said female portion of said progressive cavity pump means, and when said pump housing is in its telescopingly collapsed position said male portion is received with said helical cavity of said female portion of said progressive cavity pump means so that upon rotation of said first pump housing section relative to said second pump housing section well fluid is pumped through said housing passageway by said progressive cavity pump means.

8. The apparatus of claim 7, further comprising:

releasable interlocking means for interlocking said first and second housing sections to prevent relative rotational motion therebetween when said pump housing is in its telescopingly extended position, said interlocking means being released upon movement of said pump housing to its telescopingly collapsed position.

9. The apparatus of claim 7, further comprising:

annular seal means disposed between said first and second housing sections for sealing said housing passageway from an exterior of said housing.

10. The apparatus of claim 7, wherein:

said first housing section is telescopingly received within said second housing section.

11. The apparatus of claim 10, wherein:

said first housing section is an upper housing section and said second housing section is a lower housing section.

12. The apparatus of claim 7, wherein:

said first housing section is an upper housing section and said second housing section is a lower housing section.

13. The apparatus of claim 7, wherein:

said first housing section is telescopingly received within said second housing section;

said second housing section has a seal bore defined within an end hereof, and has an annular seal disposed in said seal bore; and said first housing section includes a polished mandrel closely and slidably received within said seal bore with an enlarged crossover head defined on an inner end of said polished mandrel received within said second housing section, said male portion of said progressive cavity pump means being attached to said crossover head and extending into said second housing section, said first housing section having a longitudinal bore extending from an outer end thereof through said polished mandrel and intersecting a laterally extending crossover port defined in said crossover head, said longitudinal bore and crossover port defining a portion of said housing passageway.

14. A method of testing a subsurface zone of a well, comprising:

(a) running into a well bore of the well a testing string having a tubing bore therethrough, said testing string including:

packer means for sealing a well annulus between said testing string and said well bore above said subsurface zone which is to be tested;

communication means for communicating well fluid from said subsurface zone with said tubing bore;

a tester valve for controlling flow of well fluid through said tubing bore; and a test pump including progressive cavity pump means for pumping said well fluid from said subsurface zone upward through said tubing bore and bypass means for allowing said well fluid to pass upwardly past said progressive cavity pump means without being pumped by said progressive cavity pump means when said subsurface zone is capable of unassisted flow, said progressive cavity pump means including a female portion having a helical cavity defined therethrough and a male portion receivable within said helical cavity, said male portion and female portions being so arranged and constructed that upon rotation of said testing string, said male portion is rotated within said helical cavity of said female portion and said well fluid is pumped upward through said helical cavity, said bypass means including a means for withdrawing said male portion from said helical cavity so that said well fluid may freely flow through said helical cavity;

(b) setting said packer within said well bore above said subsurface zone; and (c) maintaining said test pump in a bypass position with said male portion withdrawn from said helical cavity while opening said tester valve so that well fluid may freely flow from said subsurface zone up through said tubing bore when said subsurface zone is capable of unassisted flow.

15. The method of claim 14, further comprising:

(d) moving said test pump to an operative position by inserting said male portion into said helical cavity; and (e) rotating said testing string and thereby rotating said male portion relative to said helical cavity and pumping well fluid from said subsurface zone up through said tubing bore.

16. The method of claim 15, further comprising:

releasably locking said male portion relative to said female portion to prevent relative rotational motion therebetween when said test pump is in its bypass position; and during step (d), unlocking said male portion relative to said female portion.

17. The method of claim 14, further comprising:

releasably locking said male portion relative to said female portion to prevent relative rotational motion therebetween when said test pup is in its bypass position; and during step (b), maintaining said test pump in its bypass position and transmitting a rotational setting motion to said packer means through said test pump.

18. The method of claim 14, further comprising during step (a), maintaining said test pump in its said bypass position.

* * * * *